US006211774B1

(12) United States Patent
Steiner

(10) Patent No.: US 6,211,774 B1
(45) Date of Patent: Apr. 3, 2001

(54) ELECTRONIC HORN AND METHOD FOR MIMICKING A MULTI-FREQUENCY TONE

(75) Inventor: Michael D. Steiner, Post Falls, ID (US)

(73) Assignee: Electronic Controls Company, ID (US)

( * ) Notice: Subject to any disclaimer, the term of this patent is extended or adjusted under 35 U.S.C. 154(b) by 0 days.

(21) Appl. No.: 09/312,236

(22) Filed: May 14, 1999

(51) Int. Cl.[7] ..... G08B 3/10

(52) U.S. Cl. ..... 340/384.7; 116/142 R; 331/173; 340/384.3; 340/384.72

(58) Field of Search ..... 340/384.7, 384.72, 340/384.73, 384.4, 384.3, 384.5; 331/173; 116/142 R

(56) References Cited

U.S. PATENT DOCUMENTS 3,578,912 * 5/1971 Beavers, Jr. et al. ..... 340/384.3
4,204,200 5/1980 Beyl, Jr. .
4,486,742 * 12/1984 Kudo et al. .
4,689,609 * 8/1987 Ko et al. .
5,675,312 * 10/1997 Burnett ..... 340/384.72
5,754,095 5/1998 Bader et al. ..... 340/384.7

* cited by examiner

*Primary Examiner*—Brent A. Swarthout
(74) *Attorney, Agent, or Firm*—Joseph W. Holland

(57) ABSTRACT

An electronic horn for mimicking a multi-frequency tone includes a wave signal generator for generating an input signal and a complex signal generator for generating a complex signal across a transducer to mimic the sound and sound intensity of an electromechanical horn. The complex signal generator produces a complex output signal which may derive from a plurality of product signals, each product signal being derived by processing the input signal. A first product signal drives the transducer through a full bridge motor driver circuit and a second product signal is converted to a control signal by the signal processor circuit. The control signal is used to control the full bridge motor driver circuit to drive the transducer.

18 Claims, 7 Drawing Sheets

ELECTRONIC HORN AND METHOD FOR MIMICKING A MULTI-FREQUENCY TONE

DESCRIPTION

Background of the Invention

1. Technical Field

The present invention relates generally to the production of sound and more particularly to a device and a method which mimic the sound tone and sound intensity of an electromechanical horn.

2. Background

Electromechanical horns are currently employed for a wide range of uses, including for providing audible warning signals for machinery applications, particularly vehicular and mobile applications.

Electromechanical horns include a flexible diaphragm, typically formed of a metal, fixed at the outside edge to a frame, and a magnetic slug that is connected to the diaphragm. An electromagnetic coil encircles the magnetic slug. The electromagnetic coil is electrically connected to a power supply through a set of conductive contacts. When an electrical current is directed through the contacts and the electromagnetic coil, an electromagnetic field is created which opposes the field of the magnetic slug driving the magnetic slug in a first direction from its static position. The magnetic slug and the contacts are configured so that as the electromagnetic coil is energized, the movement of the magnetic slug relative to the electromagnetic coil repeatedly makes then breaks the set of conductive contacts, repeatedly defeating and reestablishing the electromagnetic field. The oscillation of the magnetic slug and the attached diaphragm produce an audible sound which is commonly directed through a horn.

A substantial amount of mechanical wear is associated with this method of producing an audible sound resulting in an operational life that is relatively short.

Beyl, Jr., U.S. Pat. No. 4,204,200 discloses an electronic horn for producing a broad spectrum frequency which includes at least two wave signal generating oscillating circuits adapted to provide square wave pulsed voltage output of a selected amplitude and different fixed frequencies. The electronic horn according to Beyl, Jr., also includes a mixing means to adaptively mix the instantaneous output signals of each signal generating oscillator to provide a stepwise varying output signal. An amplifier receives the mixed signals of the oscillator circuits, amplifies the signal and transmits the signal to a loudspeaker.

What is needed is a device that generates a complex signal using a single wave signal generator that mimics the sound and sound intensity of a multi-frequency tone of a conventional electromechanical horn. Such a device may eliminate the high wear associated with electromechanical contacts and the brittle metal diaphragm which are susceptible to a high failure rate.

What is also needed is a device that eliminates the electromagnetic interference associated with the operation of relatively large mechanical contacts as they open and close.

SUMMARY OF THE INVENTION

The electronic horn for mimicking a multi-frequency tone according to the present invention includes a wave signal generator for generating an input signal and a complex signal generator for generating a complex signal across a transducer to mimic the sound and sound intensity of an electromechanical horn. The complex signal generator is connected to the transducer. The wave signal generator may include a wave signal generating oscillating circuit for generating an input signal having a frequency ($f_x$)

The complex signal generator produces a complex output signal which may derive from a plurality of product signals. Each product signal may be the product of the division of the input signal. The complex signal generator may include a digital counter which produces a plurality of product signals, each of the plurality of product signals being a product of the division of the input signal. The plurality of product signals may be produced by dividing and redividing the input signal by a first number or a sequence of numbers.

A full bridge motor driver circuit may be conductively connected to the complex signal generator, with the transducer conductively connected to the full bridge motor driver circuit for driving the transducer with the complex output signal. In one embodiment of the invention, the transducer is a closed basket loudspeaker.

The complex signal generator may also include a signal processor circuit. In one embodiment of the invention, the signal processor circuit acts as a digital delay and may be employed to subtract portions of the input signal.

In one embodiment of the invention, three product signals produced by a digital counter are utilized, each of the three product signals being a product of the division of the input signal. A first product signal is transmitted to a transducer. A second product signal and a third product signal are transmitted to the signal processor circuit, which in this embodiment of the invention, includes an arrangement of four NOR gates. A control signal is produced by the signal processor circuit and is used to control the full bridge motor driver circuit. The two signals coming into the full bridge motor driver circuit control the output waveform. The signal going into a phase control side controls the current direction through an array of switches (transistors) inside the chip. The control signal is input to an enable pin which controls the timing of a "dead period" sent to the transducer to create a second frequency.

The full bridge motor driver circuit may include an integrated motor driver chip employed typically for motion control of a DC permanent magnet motor. Integrated motor driver chips have been employed in various applications to control the position of a motor armature. In such applications, when current is run through the motor in one direction the motor armature spins clockwise. When the current flow is reversed, the motor armature spins counter clockwise. This is what is meant by motor control and this is what the integrated motor driver chip controls, the direction of current flow through a motor, or in this case a transducer.

In the present invention a transducer acts in a sense as a single pole motor and the integrated motor driver chip controls the position of the transducer diaphragm. By using an integrated motor driver chip to control the diaphragm position, the sound produced is controlled. The device is capable of producing sounds of an essentially infinite range where a microcontroller (computer) is utilized to create the control signals to this chip. Additionally, by using an integrated motor driver chip as part of the signal logic stream the total logic needed to produce the signal can be minimized.

In one embodiment of the invention, the motor driver chip has three inputs that can be dynamically controlled. In one embodiment of the invention, two of the three inputs are used. The first input controls the phase (direction of current flow through the transducer and the frequency of diaphragm movement), the second input controls whether or not there is current flow in the transducer (on or off). In theory by controlling these two inputs, any sound could be produced. The third input may be employed in a separate embodiment of the invention to control a motor braking function built into the chip. This function may be employed to control how hard the transducer diaphragm hits the end of its throw. By having it reach the end of its throw as the transducer speed slows down (soft stop) the amount of wear to the transducer cone material or diaphragm may be reduced.

The full bridge motor driver circuit may also include a current limiting circuit for limiting current through the loudspeaker to maintain a stable dB(A) output intensity level at differing input voltage levels. This objective may be achieved employing a pulse width modulated current limit circuit. The full bridge motor driver includes logic that switches the polarity of the current that is run through the transducer and an enable pin is used to subtract parts of the waveform. This creates the missing pulses in the waveform impressed on the transducer.

The electronic horn and method according to the present invention mimic the sound of and produce a sound intensity comparable to an electromechanical horn. The present invention increases the reliability of a horn used in a variety of applications. Devices made or used in accordance with the present invention may have an extremely broad range of applications.

The electronic horn and method for mimicking a multi-frequency tone according to the present invention eliminates the high wear to electromechanical contacts and diaphragm that fail at relatively high rates particularly when subjected to cold temperatures, high usage, and water intrusion. The present invention also reduces the electromagnetic interference associated by the large mechanical contacts being opened and closed. The electronic horn according to the present invention creates a sound similar to an electromechanical horn and provides an electronic means of generating a signal desired.

A method for mimicking a multi-frequency tone according to the present invention includes the steps of:

generating an input signal from a wave signal generator;

generating a plurality of product signals, the product signals being the product of a signal processing of the input signal, the product signals including a first product signal and a second product signal;

transmitting the first signal to a full bridge motor driver circuit;

transmitting the second product signal to a signal processor circuit to generate a control signal; and controlling operation of the full bridge motor driver circuit with the control signal to generate a complex signal across a transducer.

Additional advantages and novel features of the invention will be set forth in part in the description that follows, and in part will become apparent to those skilled in the art upon examination of the following, or may be learned by practice of the invention. The advantages of the invention may be realized and attained by means of the instrumentalities and combinations particularly pointed out in the appended claims.

DETAILED DESCRIPTION OF THE INVENTION

Figure 1:
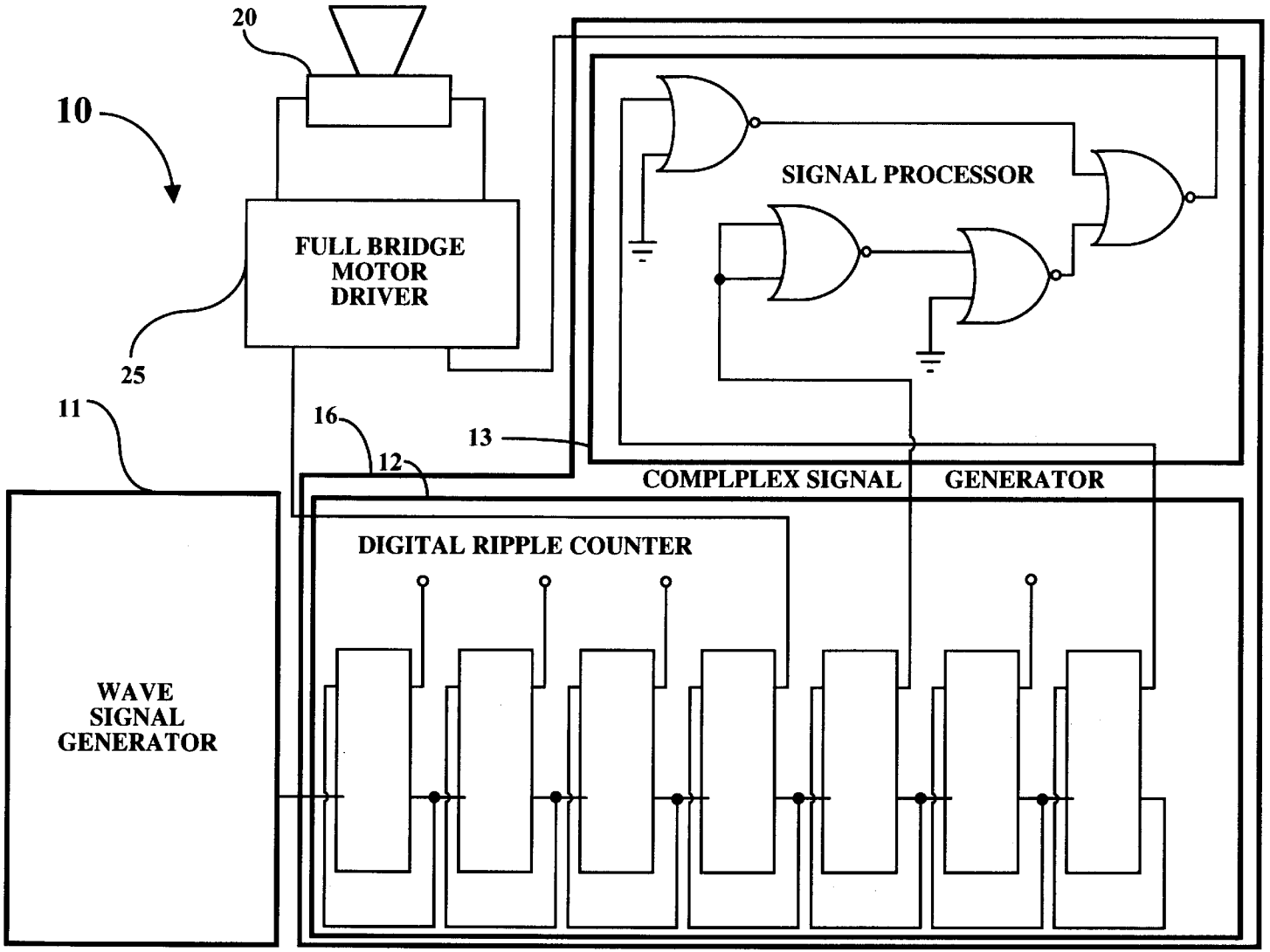
FIG. 1 is a logic block diagram of a circuit for mimicking a multi-frequency tone according to the present invention.

FIG. 1 is a system logic block diagram of one embodiment of electronic horn 10 according to the present invention. Electronic horn 10 includes wave signal generator 11 providing an input to complex signal generator 16. Complex signal generator 16 includes digital ripple counter 12 and signal processor circuit 13. Wave signal generator 11 generates an input signal having frequency ($f_x$) which may be in the range of 10 kHz to 200 kHz.

Figure 10:
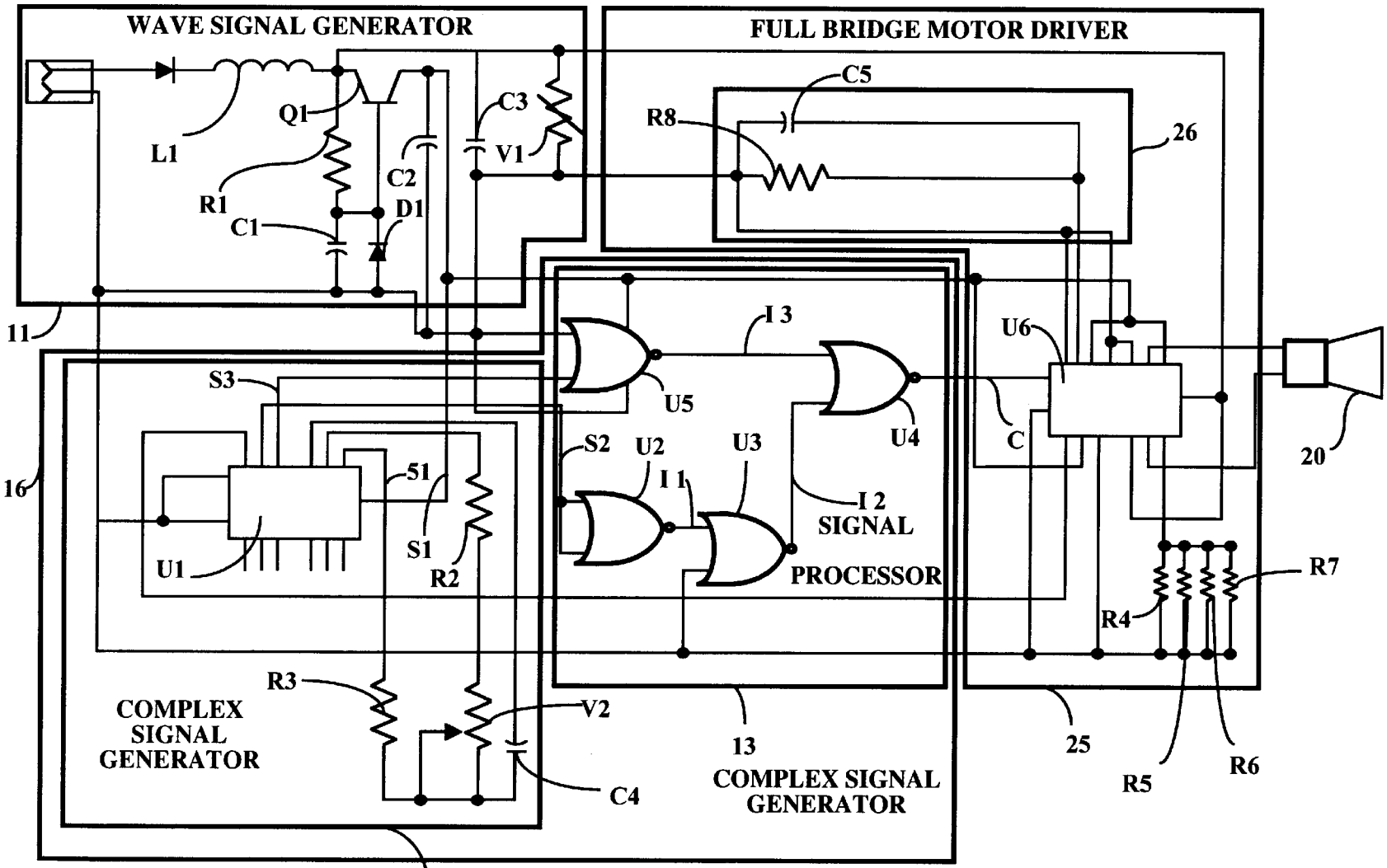
FIG. 10 is a schematic diagram of a circuit according to the present invention.

Digital ripple counter 12 divides and redivides input signal having frequency ($f_x$) Digital ripple counter 12 is conductively connected to full bridge motor driver circuit 25 through signal processor circuit 13. Pulse width modulated current limit circuit 26 may be employed as shown in FIG. 10 to control the sound intensity (dB(A)) output at different input voltages. Loudspeaker 20 is conductively connected to full bridge motor driver circuit 25.

Figure 2:
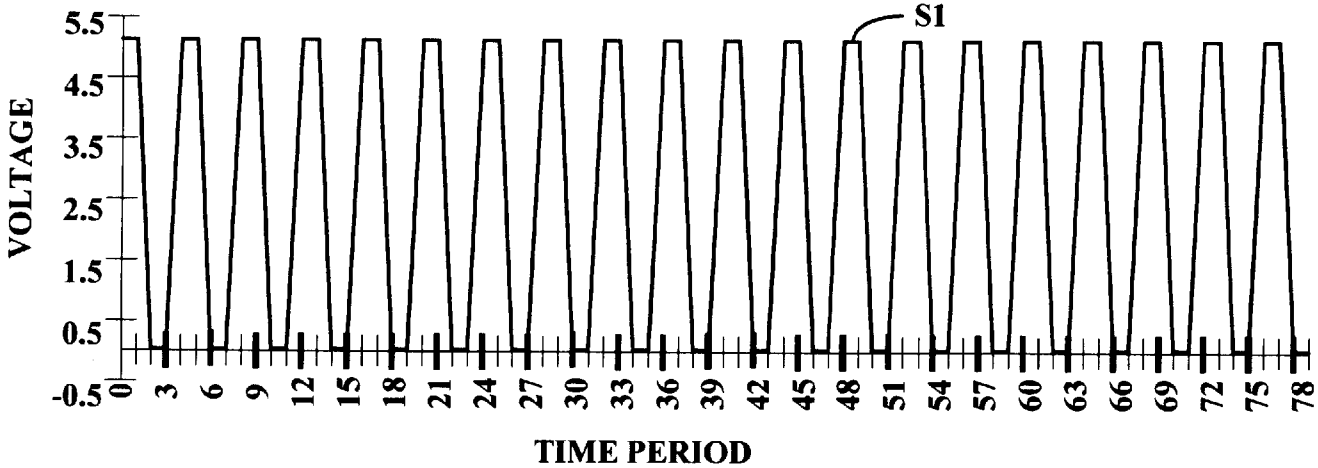
FIG. 2 is a depiction of the product of an input signal having frequency ($f_x$) divided by 16 to produce a first product signal S1.

FIG. 2 shows the product of an input signal having frequency ($f_x$) divided by 16 to produce first product signal S1. Preferably, the divided frequency, first product signal S1, equals the resonant frequency of loudspeaker 20. First product signal S1 directly determines the direction of current flow (phase direction) through loudspeaker 20.

Figure 3:
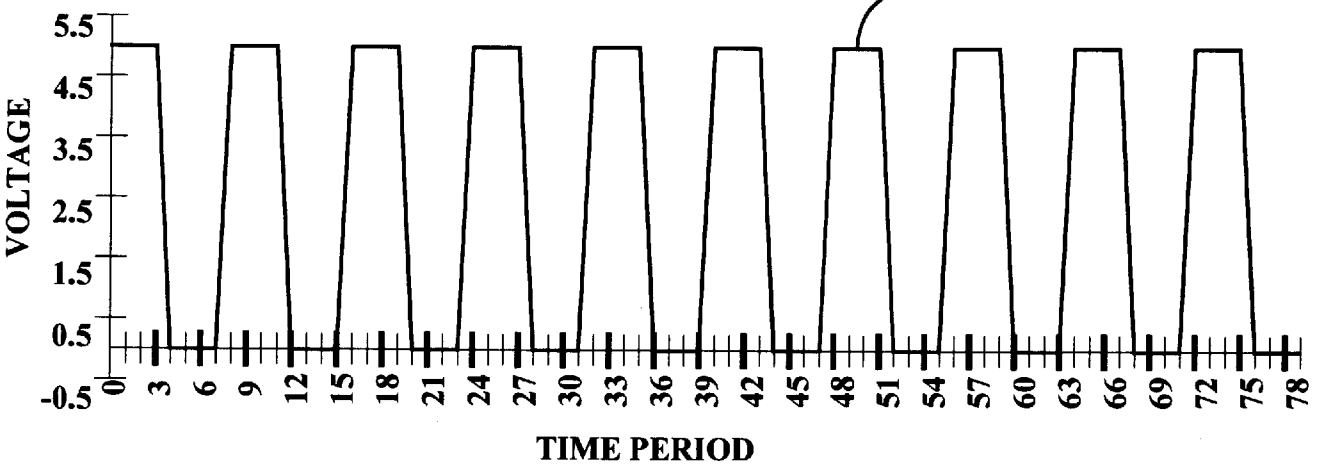
FIG. 3 is a depiction of the product of an input signal having frequency ($f_x$) divided by 32 to produce a second product signal S2.

FIG. 3 shows the product of an input signal having frequency ($f_x$) divided by 32 to produce second product signal S2.

Figure 4:
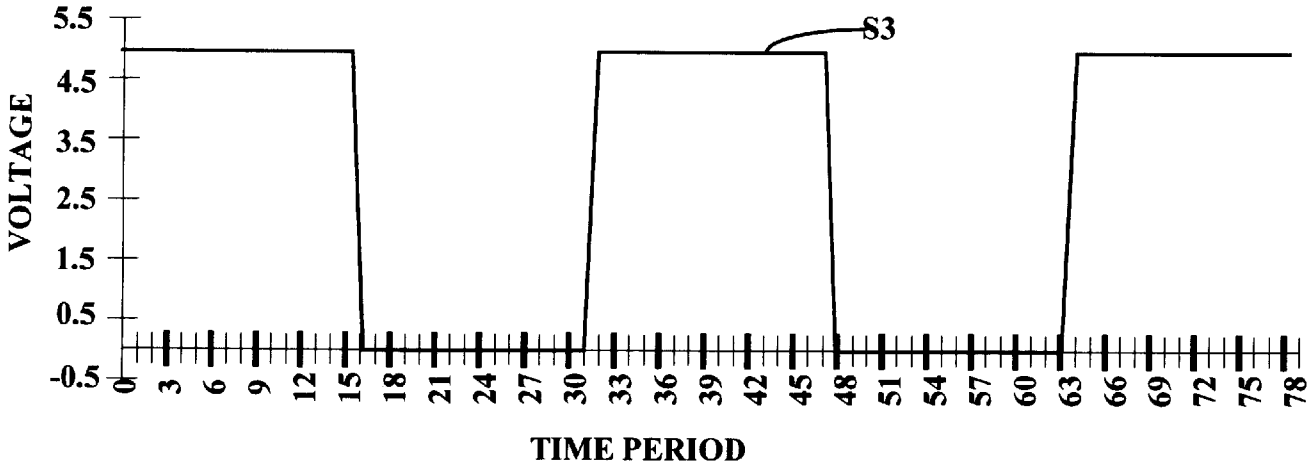
FIG. 4 is a depiction of the product of an input signal having frequency ($f_x$) divided by 128 to produce a third product signal S3.

FIG. 4 shows the product of an input signal having frequency ($f_x$) divided by 128 to produce third product signal S3.

Figure 5:
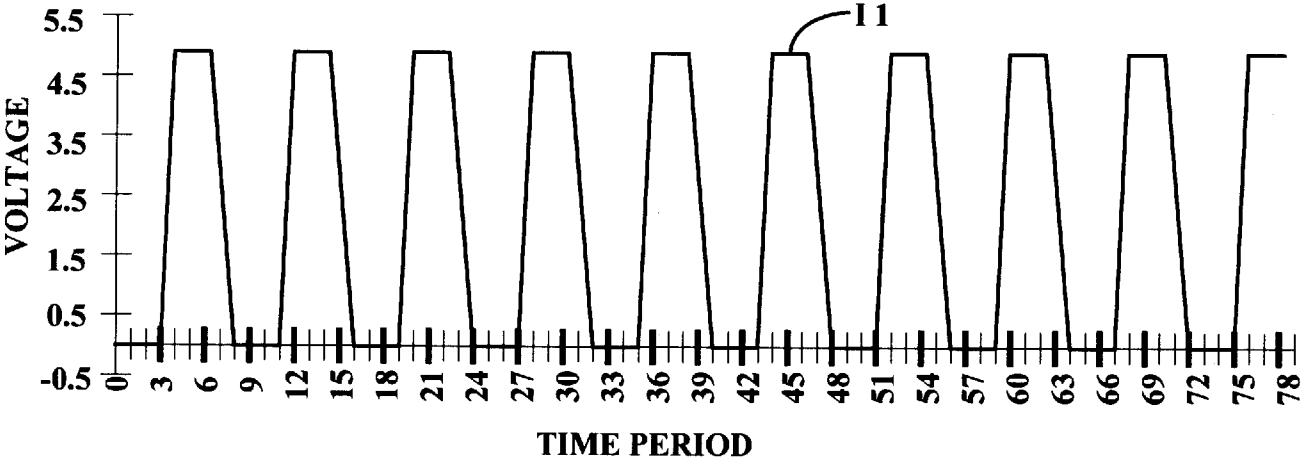
FIG. 5 is a depiction of first interim signal I1.
Figure 7:
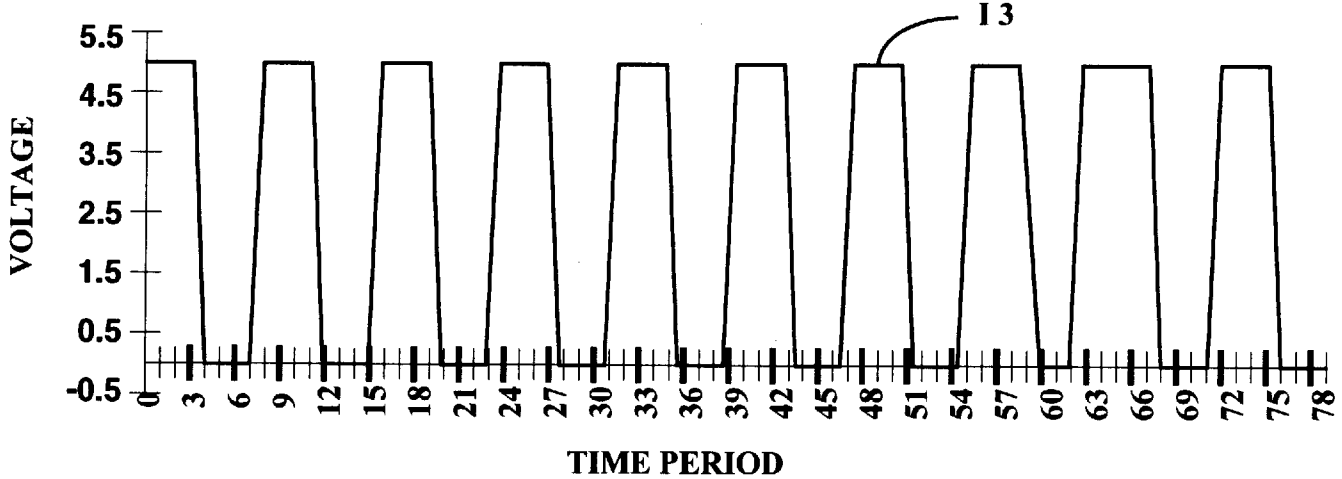
FIG. 7 is a depiction of third interim signal I3.

As shown in FIG. 10, second product signal S2 is transmitted to signal processor circuit 13, specifically to Integrated circuit U2, an inverter connected NOR gate. Second product signal S2 is thereby inverted and delayed at integrated circuit U2. First interim signal I1 is produced by integrated circuit U2 and transmitted to integrated circuit U3, another inverter connected NOR gate. First interim signal I1 is shown In FIG. 5. First interim signal I1 is inverted and delayed at integrated circuit U3. Third interim signal I3 is produced by integrated circuit U3 and transmitted to integrated circuit U4, another inverter connected NOR gate. Third interim signal I13 is shown in FIG. 7.

Figure 6:
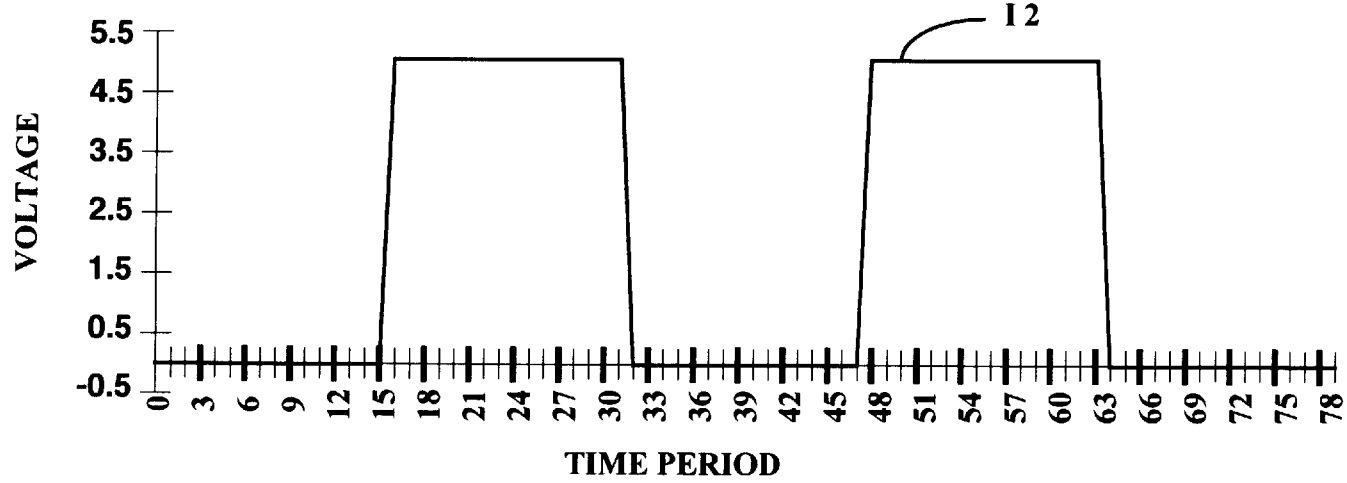
FIG. 6 is a depiction of second interim signal I2.

Third product signal S3 is transmitted to signal processor circuit 13, specifically to integrated circuit U5, an inverter connected NOR gate. Third product signal S3 is thereby inverted and delayed. Second interim signal I2 is produced by integrated circuit U5 and transmitted to integrated circuit U4. Second interim signal I2 is shown in FIG. 6.

Figure 8:
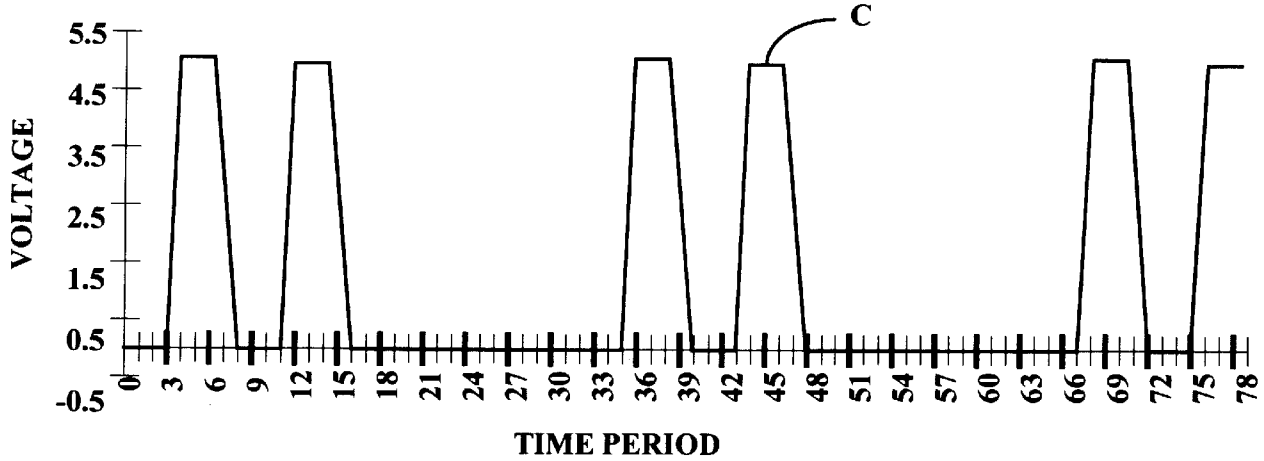
FIG. 8 is a depiction of control signal C.

Second interim signal I2 and third interim signal I3 are inverted and delayed at integrated circuit U4. Control signal C is produced by signal processor circuit 13, specifically integrated circuit U4 to control full bridge motor driver circuit 25 via an enable pin. Control signal C is shown at FIG. 8.

In the embodiment of the invention shown, when control signal C equals zero, full bridge motor driver circuit 25 is enabled and current flows through the loudspeaker 20. When control signal C equals a preselected value, which in one embodiment of the invention is equal to 5 volts, full bridge motor driver circuit 25 is disabled and no current flows through loudspeaker 20.

Figure 9:
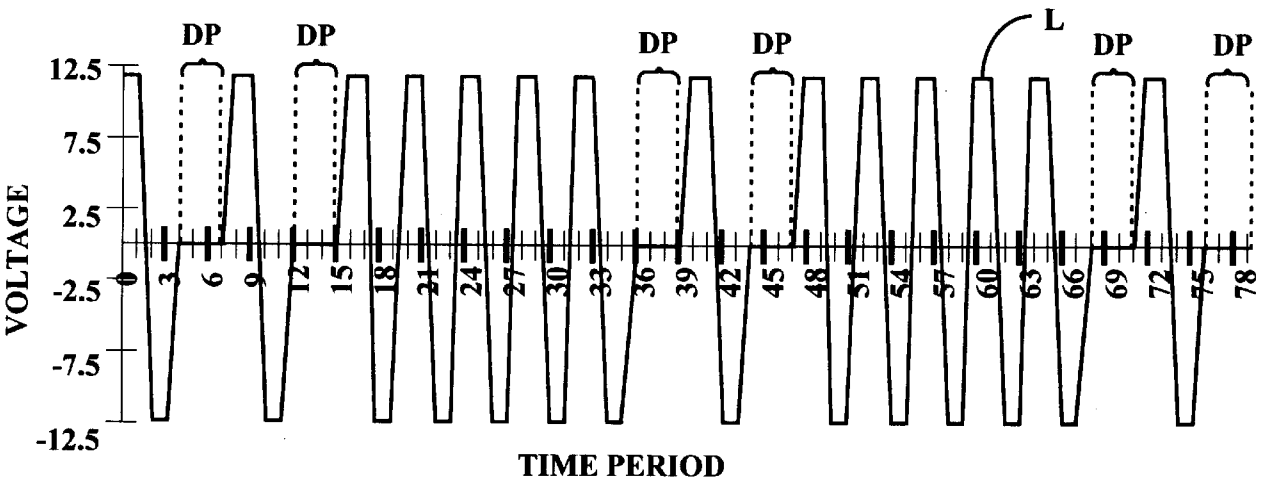
FIG. 9 is a depiction the output voltage signal L across the loudspeaker.

Output signal L across loudspeaker 20 is depicted in FIG. 9.

Full bridge motor driver circuit 25 may include pulse width modulated current limit circuit 26 which limits the current across closed basket loudspeaker 20. This feature is used to control the sound intensity (dB(A)) output at different input voltages. By limiting the current across loudspeaker 20 the dB(A) output can be controlled when the voltage input is changed.

First product signal S1, second product signal S2, third product signal S3, first interim signal I1, second interim signal I2, third interim signal I3, control signal C and output signal $L_1$ shown at FIGS. 2 through 9 respectively, do not reflect the propagation delay as the signal ripples through the system. Rather, first product signal S1, second product signal S2, third product signal S3, first interim signal I1, second interim signal I2, third interim signal I3, control signal C and output signal $L_1$ a shown at FIGS. 2 through 9 respectively assume zero delay for clarity.

FIG. 10 is a schematic diagram depicting one embodiment of electronic horn 10 according to the present invention. Electronic horn 10 includes wave signal generator 11 providing an input to complex signal generator 16 specifically, to digital ripple counter 12. Digital ripple counter 12 is conductively connected to signal processor circuit 13 and full bridge motor driver circuit 25 which in the embodiment of the invention shown in FIG. 10 includes pulse width modulated current limit circuit 26. Loudspeaker 20 is conductively connected to and driven by full bridge motor driver circuit 25.

Figure 11:
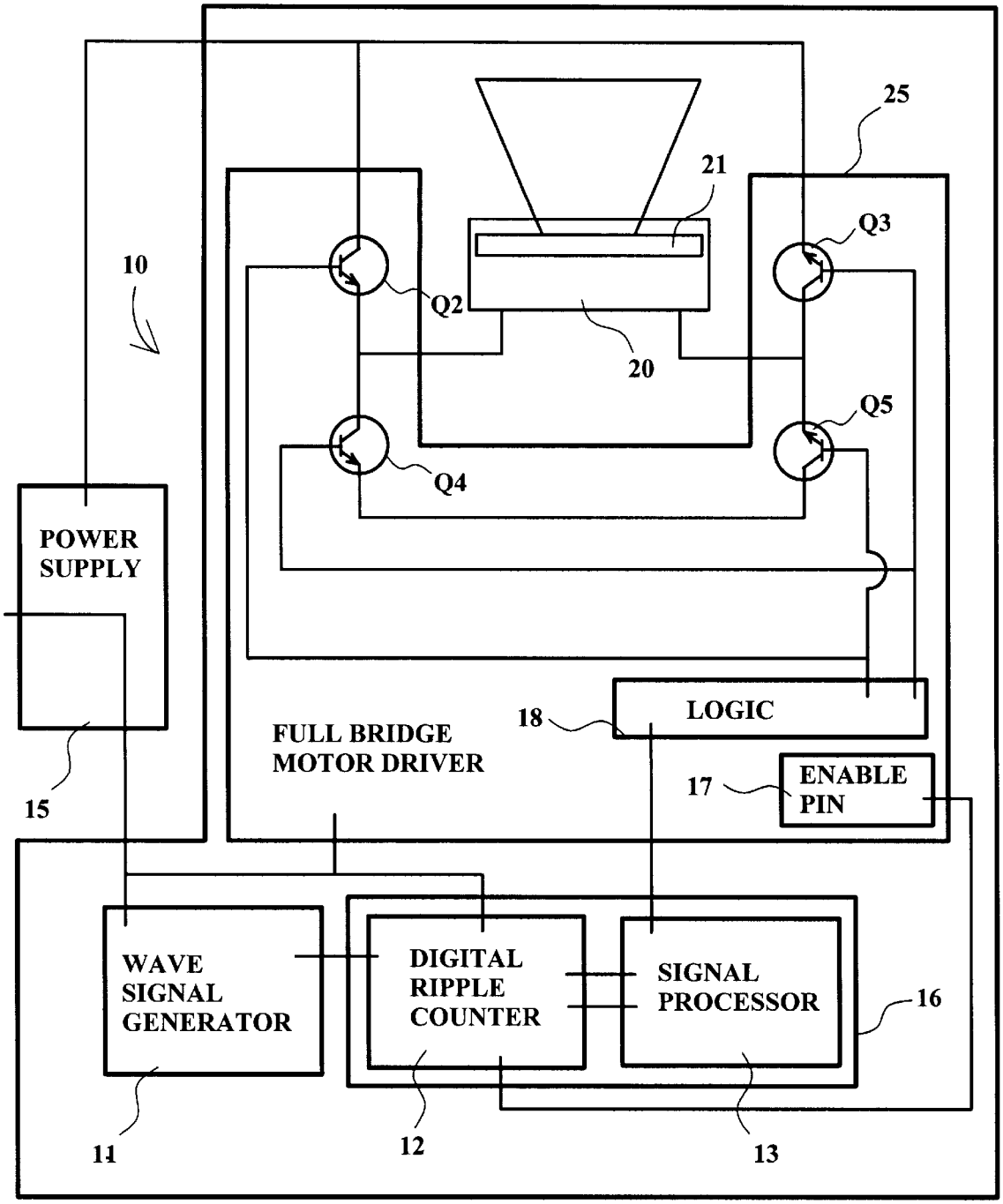
FIG. 11 is a logic diagram according to the present invention.

FIG. 11 is a system block diagram showing one embodiment of electronic horn 10. Electronic horn 10 is shown including input power supply 15 connected to wave signal generator 11. Wave signal generator 11 is connected to and provides an input signal to complex signal generator 16 specifically, to digital ripple counter 12. Wave signal generator 11 generates an input to full bridge motor driver circuit 25 through signal processor circuit 13. Full bridge motor driver circuit 25 includes four transistors Q2, Q3, Q4 and Q5 and logic device 16. Logic circuit 18 controls which transistors turn on at any given time. In the embodiment shown, logic circuit 18 controls the transistors in pairs operating transistors Q2 and Q4 simultaneously and transistors Q3 and Q5 simultaneously and one-hundred and eighty degrees out of phase with transistors Q2 and Q4. Logic circuit 18 also controls the current limit.

Referring to FIG. 2, when first product signal S1 is equal to or greater than 5V logic circuit 18 controls transistors Q2 and Q4 or Q3 and Q5 operate to open (no current flow) or close (current will flow).

Referring to FIG. 9, by way of illustration and not intending to limit the scope of the present invention, as output signal L goes positive transistors Q2 and Q4 are closed and transistors Q3 and Q5 are open. This allows current through the transducer to flow in a first direction and transducer 20 diaphragm 21 moves according to the polarity of the current at the transducer. The next time period output signal L moves once again, according to the polarity of the current at the transducer. Transistors Q3 and Q5 close and transistors Q2 and Q4 open allowing current to flow in a second direction and transducer 20 diaphragm 21 moves the opposite end of its throw. This process is repeated four times in a row creating a sound at the frequency ($f_x$) After four movements at $f_x$ a dead period DP is inserted (or the waveform is subtracted from the signal). Dead period DP is created by operation of enable pin 17 of full bridge motor driver circuit 25. Control signal C, shown at FIG. 8, is input to enable pin 17 which controls the timing of dead period DP sent to the transducer to create a second frequency. The process of transmission of a first frequency $f_x$ followed by dead period DP repeats, mimicking a multi frequency tone. Dead period DP effectively creates a second sound at a frequency other than $f_x$, (i.e. $f_x/2$). The sound emitted at transducer 20 is the summation of 2 frequencies, mimicking a multi-frequency tone.

The following is an identification of various components of the circuits described herein, it being understood that specified components may be varied and/or replaced by other suitable components depending upon the particular application, and that any such replacement or substitution still falls within the scope of the present invention.

Wave signal generating oscillating circuit 11 as shown in FIG. 10 includes the components:

| | |
|---|---|
| capacitor C1 | 1 μF 25 V |
| capacitor C2 | 100 μF 50 V |
| capacitor C3 | 100 μF 50 V |
| diode D1 | 1 W 6.2 V, zener diode |
| diode D2 | 1 A, rectifier diode |
| inductor L1 | 100 μH |
| resistor R1 | 1 W 510 OHM |
| transistor Q1 | MPSW42RLRA, MOT |
| varistor V1 | ERZC20DK560, 56 V |

Digital ripple counter 12 as shown in FIG. 10 includes the components:

| | |
|---|---|
| capacitor C4 | 1000PF 50 V |
| integrated circuit U1 | CD4060BCN |
| resistor R2 | 5K |
| resistor R3 | 100K |
| varistor V2 | TRIMPOT 50K OHM |

Signal processor circuit 13 as shown in FIG. 10 includes the components:

| | |
|---|---|
| integrated circuit U2 | CMOS NOR GATE, CD4001 |
| integrated circuit U3 | CMOS NOR GATE, CD4001 |
| integrated circuit U4 | CMOS NOR GATE, CD4001 |
| integrated circuit U5 | CMOS NOR GATE, CD4001 |

Full bridge motor driver circuit 25 as shown in FIG. 10 includes the components:

| | |
|---|---|
| integrated circuit U5 | A3952SB |
| resistor R4 | 1.3 OHM |
| resistor R5 | 1.3 OHM |
| resistor R6 | 1.3 OHM |
| resistor R7 | 1.3 OHM |

Pulse width modulated current limit circuit 26 as shown in FIG. 10 includes the components:

| | |
|---|---|
| capacitor C5 | 470 pF |
| resistor R8 | 8.6K |

Loudspeaker 20 as shown in FIG. 10 includes an eight ohm, 66 mm diameter, closed basket loudspeaker.

While this invention has been described with reference to the described embodiments, this is not meant to be construed in a limiting sense. Various modifications to the described embodiments, as well as additional embodiments of the invention, will be apparent to persons skilled in the art upon reference to this description, the drawings and the appended claims. For example, a discrete or chip based pulse generator could be substituted for the wave signal oscillator shown. Similarly, a discrete or chip based pulse generators could be substituted for the wave signal generator altogether. The counter could also be replaced by a simple pulse generator. The logic may be created by NOR gates, or in the alternative, a variety of signals may be produced using a variety of transistor gates including NAND, AND, OR gates or any combination of these. Along with the combinational logic even more complex waveforms may be created and could be useful in implementing the present invention. The complex signal generator may comprise a microprocessor for generating a complex signal.

The full bridge motor driver circuit may be created using discrete logic and discrete power transistors. Similarly, the entire circuit may be manufactured using discrete transistor logic on a single chip in the form of an application specific integrated circuit (ASIC). The present invention not limited to the single waveform described in the application. For instance the logic section of the design may be changed employing more elaborate processors and programs to produce different waveforms just by controlling the input to the full bridge motor driver circuit as described. A variety of output waveforms have been created employing the method of this invention.

It is therefore contemplated that the appended claims will cover any such modifications or embodiments as fall within the scope of the invention.

I claim:

1. An electronic horn for mimicking a multi-frequency tone comprising:

a wave signal generator for generating an input signal;

a complex signal generator conductively connected to the wave signal generator, the input signal being conducted to the complex signal generator, the complex signal generator processing the input signal to produce a first product signal and a control signal;

a full bridge motor driver circuit conductively connected to the complex signal generator, the first product signal and the control signal being conducted to the full bridge motor driver circuit; and a transducer conductively connected to the full bridge motor driver circuit.

2. The electronic horn of claim 1 wherein the complex signal generator further comprises:

a digital counter conductively connected to the wave signal generator; and a signal processor circuit counter conductively connected to the digital counter.

3. The electronic horn of claim 2 wherein the complex signal generating circuit further comprises:

a digital counter producing a first product signal and a second product signal, the digital counter conducting the first product signal to the transducer; and a signal processor circuit, the digital counter transmitting the second product signal to the signal processor circuit, the signal processor circuit producing a control signal for transmission to the transducer.

4. The electronic horn of claim 1 wherein the full bridge motor driver circuit further comprises an integrated motor driver chip.

5. The electronic horn of claim 1 wherein the transducer further comprises a loudspeaker.

6. An electronic horn for mimicking a multi-frequency tone comprising:

a wave signal generator for generating an input signal;

a digital counter conductively connected to the wave signal generator, the digital counter producing a first product signal, a second product signal and a third product signal;

a signal processor circuit, the digital counter transmitting the second product and the third product signal to the signal processor circuit, the signal processor circuit producing a control signal;

a full bridge motor driver circuit conductively connected to the digital counter and the signal processor circuit, the digital counter conducting the first product signal to the full bridge motor driver circuit and the signal processor circuit conducting the control signal to the full bridge motor driver circuit;

a transducer conductively connected to the full bridge motor driver circuit.

7. The electronic horn of claim 6 wherein the first product signal is a product of the division of the input signal.

8. The electronic horn of claim 6 wherein the second product signal is a product of the division of the input signal.

9. The electronic horn of claim 6 wherein the third product signal is a product of the division of the input signal.

10. The electronic horn of claim 6 wherein the signal processor circuit further comprises:

a first NOR gate conductively connected to the digital counter, the digital counter transmitting the second product signal to the first NOR gate;

a second NOR gate conductively connected to the first NOR gate, the first NOR gate transmitting a first interim signal to the second NOR gate;

a third NOR gate conductively connected to the digital counter, the digital counter transmitting the third product signal to the third NOR gate; and a fourth NOR gate conductively connected to the second NOR gate, the third NOR gate and the full bridge motor driver circuit, the second NOR gate transmitting a second interim signal to the fourth NOR gate and the third NOR gate transmitting a third interim signal to the fourth NOR gate, the fourth NOR gate transmitting a control signal to the full bridge motor driver circuit.

11. The electronic horn of claim 10 wherein the first interim signal is a product of a first logic function of the first NOR gate.

12. The electronic horn of claim 10 wherein the second interim signal is a product of a second logic function of the second NOR gate.

13. The electronic horn of claim 10 wherein the third interim signal is a product of a third logic function of the third NOR gate.

14. The electronic horn of claim 10 wherein the control signal is a product of a fourth logic function of the fourth NOR gate.

15. The electronic horn of claim 6 wherein the full bridge motor driver circuit further comprises an integrated motor driver chip.

16. The electronic horn of claim 6 wherein the transducer further comprises a loudspeaker.

17. A method for mimicking a multi-frequency tone including the acts of:

generating an input signal having a frequency ($f_x$) with an input signal generating circuit;

processing the input signal to produce a plurality of product signals;

transmitting a first product signal to a full bridge motor driver circuit;

transmitting at least a second product signal to a signal processor circuit to generate a control signal; and controlling operation of the full bridge motor driver circuit with the control signal to generate a complex signal across a transducer for mimicking an electromechanical horn.

18. A method for mimicking a multi-frequency tone including the acts of:

generating an input signal having a frequency with an input signal generator;

processing the input signal to produce a first product signal, a second product signal and a third product signal;

transmitting the first product signal to a full bridge motor driver circuit;

transmitting the second product signal and the third product signal to a signal processor circuit to generate a control signal; and controlling an operation of the full bridge motor driver circuit with the control signal to generate a complex signal across a transducer for mimicking an electromechanical horn.

* * * * *